US007766446B2

(12) United States Patent
Nakata et al.

(10) Patent No.: US 7,766,446 B2
(45) Date of Patent: Aug. 3, 2010

(54) POSITION DETECTOR AND LIQUID EJECTING APPARATUS INCORPORATING THE SAME

(75) Inventors: Satoshi Nakata, Nagano (JP); Hitoshi Igarashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 995 days.

(21) Appl. No.: 11/520,421

(22) Filed: Sep. 12, 2006

(65) Prior Publication Data

US 2007/0057976 A1 Mar. 15, 2007

(30) Foreign Application Priority Data

Sep. 12, 2005 (JP) ..... 2005-263444

(51) Int. Cl.
*B41J 29/38* (2006.01)
*B41J 29/393* (2006.01)

(52) U.S. Cl. ..... 347/19; 347/5; 347/9

(58) Field of Classification Search ..... 347/5, 347/8, 9, 16, 19, 101, 104, 14
See application file for complete search history.

(56) References Cited

U.S. PATENT DOCUMENTS 3,496,364 A * 2/1970 Foskett et al. ..... 250/550
3,619,489 A * 11/1971 Frohbach et al. ..... 348/291
4,078,173 A * 3/1978 Fultz ..... 250/237 G
4,180,703 A * 12/1979 Cialone et al. ..... 250/237 G
4,529,964 A * 7/1985 Minami et al. ..... 341/13
4,607,956 A * 8/1986 Ishihara et al. ..... 356/616
4,672,201 A * 6/1987 Welker ..... 250/231.16
4,709,248 A * 11/1987 Piatt et al. ..... 347/14
5,075,609 A * 12/1991 Ito et al. ..... 318/696

(Continued)

FOREIGN PATENT DOCUMENTS

JP 57198812 A * 12/1982

(Continued)

*Primary Examiner*—Stephen D Meier
*Assistant Examiner*—Leonard S Liang
(74) *Attorney, Agent, or Firm*—Nutter McClennen & Fish LLP; John J. Penny, V

(57) ABSTRACT

A light emitter is operable to emit light. A light receiver is adapted to receive the light emitted from the light emitter, and operable to output a signal in accordance with an amount of the received light, thereby detecting a position of an object. At least one transparent member is disposed between the light emitter and the light receiver. A first line pattern is provided with the transparent member so as to oppose the light emitter, and includes first light transmitting sections and first light shielding sections which are alternately arranged in a first direction with a first pitch. A second line pattern is provided with the transparent member so as to oppose the light receiver, and includes second light transmitting sections and second light shielding sections which are alternately arranged in the first direction with a second pitch. Each of the first light transmitting sections is adapted to allow the light emitted from the light emitter to pass through. Each of the first light shielding sections is adapted to shield the light emitted from the light emitter. Each of the second light transmitting sections is adapted to allow light having passed through the transparent member. Each of the second light shielding sections is adapted to shield the light having passed through the transparent member.

5 Claims, 7 Drawing Sheets

U.S. PATENT DOCUMENTS

| | | | | | |
|---|---|---|---|---|---|
| 5,182,613 | A * | 1/1993 | Ieki et al. | 356/619 |
| 5,563,591 | A * | 10/1996 | Jacobs et al. | 341/13 |
| 5,748,373 | A * | 5/1998 | Hane et al. | 359/575 |
| 6,010,206 | A * | 1/2000 | Simons | 347/40 |
| 6,264,303 | B1 * | 7/2001 | Watanabe | 347/37 |
| 6,422,682 | B1 * | 7/2002 | Kaneko et al. | 347/37 |
| 6,972,403 | B2 * | 12/2005 | Martenson et al. | 250/231.13 |
| 7,265,336 | B2 * | 9/2007 | Hataguchi et al. | 250/231.13 |
| 7,417,218 | B2 * | 8/2008 | Yamamoto et al. | 250/231.13 |
| 2003/0169311 | A1 * | 9/2003 | Kong Leong et al. | 347/19 |
| 2007/0034786 | A1 * | 2/2007 | Oka et al. | 250/231.13 |

FOREIGN PATENT DOCUMENTS

| | | | |
|---|---|---|---|
| JP | 09089595 | A * | 4/1997 |
| JP | 2004-202963 | | 7/2004 |
| JP | 2005-81691 | | 3/2005 |

* cited by examiner

POSITION DETECTOR AND LIQUID EJECTING APPARATUS INCORPORATING THE SAME

BACKGROUND

1. Technical Field

The present invention relates to a position detector and a liquid ejecting apparatus incorporating the same.

2. Related Art

In an ink jet printer, a carriage and a printed subject such as paper are driven by a motor. Incidentally, in order to perform position control and speed control, an encoder is generally used. The encoder includes a photo sensor and a scale. The photo sensor includes a light emitting element and a light receiving element the scale includes a light transmitting section which transmits light emitted from the light emitting element, and a light shielding section which shields light emitted from the light emitting element. These light transmitting section and light shielding section are repetitively arranged at a fixed pitch.

In such the encoder, recently, there is a problem of attachment of ink mist. Namely, recent printers which perform printing with high precision can eject minute ink droplets from a printing head. These minute ink droplets readily become ink mist and drift inside the printer. Therefore, as such the printer is used for a while, solidified ink mist is piled on the scale.

Japanese Patent Publication No. 2005-81691A (JP-A-2005-81691) teaches that a partition member is arranged between a carriage belt and a scale to prevent the attachment of the ink mist onto the scale. Japanese Patent Publication No. 2004-202963A (JP-A-2004-202963) discloses a configuration for correcting, in a case where duty factor of a signal outputted from a light receiving element decreases due to the attached ink mist, the duty factor of the output signal so as to become 50%.

In a case where the ink mist is attached onto the light transmitting section of the scale, light which passes through the light transmitting section is diffracted and causes a disadvantageous effect. Any means for preventing such the disadvantage has not been disclosed in the above publications.

SUMMARY

It is an advantage of some aspects of the invention to provide a position detector which can prevent diffraction of light which passes through a light transmitting section of a scale and prevent erroneous detection in a light receiving element, and to provide a liquid ejecting apparatus incorporating such a position detector.

According to one aspect of the invention, there is provided a position detector, comprising:

a light emitter, operable to emit light;

a light receiver, adapted to receive the light emitted from the light emitter, and operable to output a signal in accordance with an amount of the received light, thereby detecting a position of an object;

at least one transparent member, disposed between the light emitter and the light receiver;

a first line pattern, provided with the transparent member so as to oppose the light emitter, and including first light transmitting sections and first light shielding sections which are alternately arranged in a first direction with a first pitch; and a second line pattern, provided with the transparent member so as to oppose the light receiver, and including second light transmitting sections and second light shielding sections which are alternately arranged in the first direction with a second pitch, wherein:

each of the first light transmitting sections is adapted to allow the light emitted from the light emitter to pass through;

each of the first light shielding sections is adapted to shield the light emitted from the light emitter;

each of the second light transmitting sections is adapted to allow light having passed through the transparent member; and each of the second light shielding sections is adapted to shield the light having passed through the transparent member.

With this configuration, only the light emitted from the light emitter and having reached the first light transmitting section passes through the transparent member, and the light that has reached the first light shielding section is shielded and does not pass through the transparent member. The light that has passed through the transparent member then reaches the second line pattern. Here, only the light that has reached the second light transmitting section passes toward the light receiver side, and the light that has reached the second light shielding section is blocked. Therefore, of the light emitted from the light emitter, only the light that has passed through both of the first light transmitting section and the second light transmitting section is received in the light receiver.

Thus, the light of which the traveling direction deviates from the predetermined direction, though passing through the first light transmitting section, can be shielded by the second light shielding section, and only the light in the predetermined traveling direction can be received by the light receiver. Hereby, in the light receiver, reception of the excessively diffused or diffracted light can be suppressed. Therefore, the light receiver can output the electric signal corresponding to the light in the predetermined traveling direction, and can improve detection accuracy of the light in the predetermined traveling direction. Namely, detection sensitivity in the light receiver can be improved, so that the erroneous detection can be prevented.

The first pitch and the second pitch may be identical.

In this case, the traveling direction of the light that has passed through both of the first transmitting section and the second light transmitting section can be made uniform.

The transparent member may have a first surface adapted to oppose the light emitter and a second surface adapted to oppose the light receiver. The first line pattern may be provided on the first surface. The second line pattern may be provided on the second surface.

In this case, it is possible to avoid the increase of dimension in the thickness direction of the transparent member, in comparison with the two line patterns are respectively provided on individual transparent members. Further, influences by light reflection from the first surface can be reduced.

Each boundary between one of the first light transmitting sections and one of the first light shielding sections which are adjacent to each other may be aligned with an associated boundary between one of the first light transmitting sections and one of the first light shielding sections which are adjacent to each other, relative to a thickness direction of the transparent member which is orthogonal to the first direction.

In this case, the light having passed through the transparent member is made parallel relative to the thickness direction of the transparent member. Thus, in the light receiver, the influences of the diffused or diffracted light can be reduced.

The at least one transparent member may include a first transparent member and a second transparent member. The first line pattern may be provided on the first transparent member. The second line pattern may be provided on the second transparent member.

In this case, it is possible to obtain the desired two line patterns by merely laminating two transparent members while positioning the respective line patterns. Further, relative position between two line patterns can be easily corrected.

The light receiver may include a plurality of light receiving elements arrayed in the first direction. A dimension in the first direction of one of the first light transmitting sections and one of the light shielding sections which are adjacent to each other may correspond to a dimension in the first direction of an odd number of the light receiving elements.

In this case, at least one of the light receiving elements must be associated with each of the light transmitting sections and the light shielding sections. Therefore, among these light receiving elements, the signals in which the phase is shifted by 180 degrees can be outputted, and it is possible to obtain an encoder signal having high accuracy by comparison between these signals.

According to one aspect of the invention, there is provided a liquid ejecting apparatus, comprising:

a liquid ejecting head, operable to eject liquid toward a target medium; and the above position detector, operable to detect a position of the liquid ejecting head as the object.

In this case, since the erroneous detection of the position detector can be prevented, it is possible to eject the liquid toward the target medium accurately.

The liquid may be pigment-base ink.

In this case, the reception of the excessively diffused or diffracted light can be suppressed even when the pigment-base ink which tends to cause the light diffraction is attached onto the transparent member.

BRIEF DESCRIPTION OF THE DRAWINGS

The invention will be described with reference to the accompanying drawings, wherein like numbers reference like elements.

DESCRIPTION OF EXEMPLARY EMBODIMENTS

A position detector according to one embodiment of the invention and a printer 10 using this position detector will be described below with reference to FIGS. 1 to 10. The printer 10 in the embodiment is an ink jet type printer. However, such the ink jet printer, as long as it can eject ink to perform printing, may adopt any ejection method.

In the following description, a "downside" indicates a side on which the printer 10 is placed, and an "upside" indicates a side apart from the side on which the printer 10 is placed. A direction where a carriage 31 described later moves is taken as a primary scanning direction, and a direction which is orthogonal to the primary scanning direction and where a printed subject P is transported is taken as a secondary scanning direction.

Figure 1:
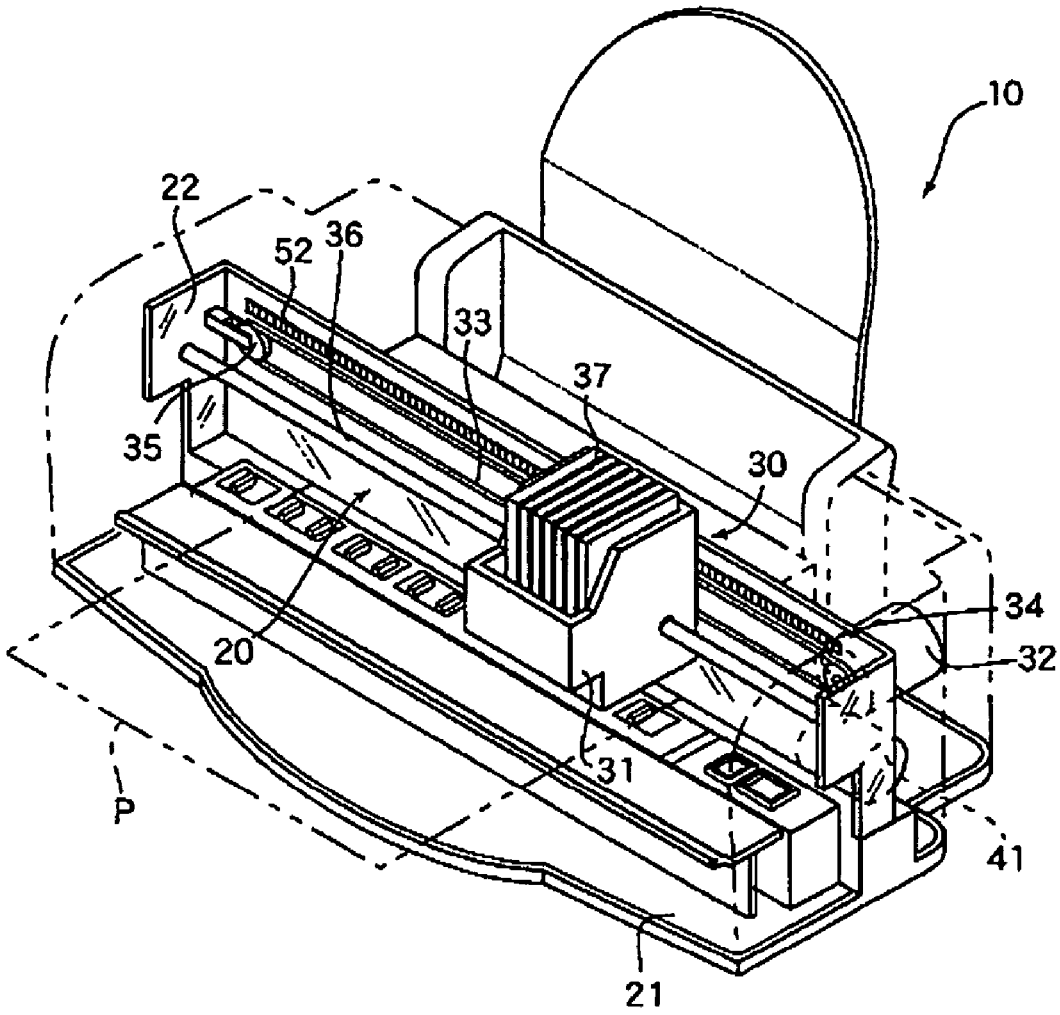
FIG. 1 is a perspective view of a printer incorporating a position detector according to one embodiment of the invention.

As shown in FIG. 1, the printer 10 comprises a housing 20, a carriage driving mechanism 30, a sheet transporting mechanism 40, a linear encoder 50, a rotary encoder 70, and a controller 80.

Figure 2:
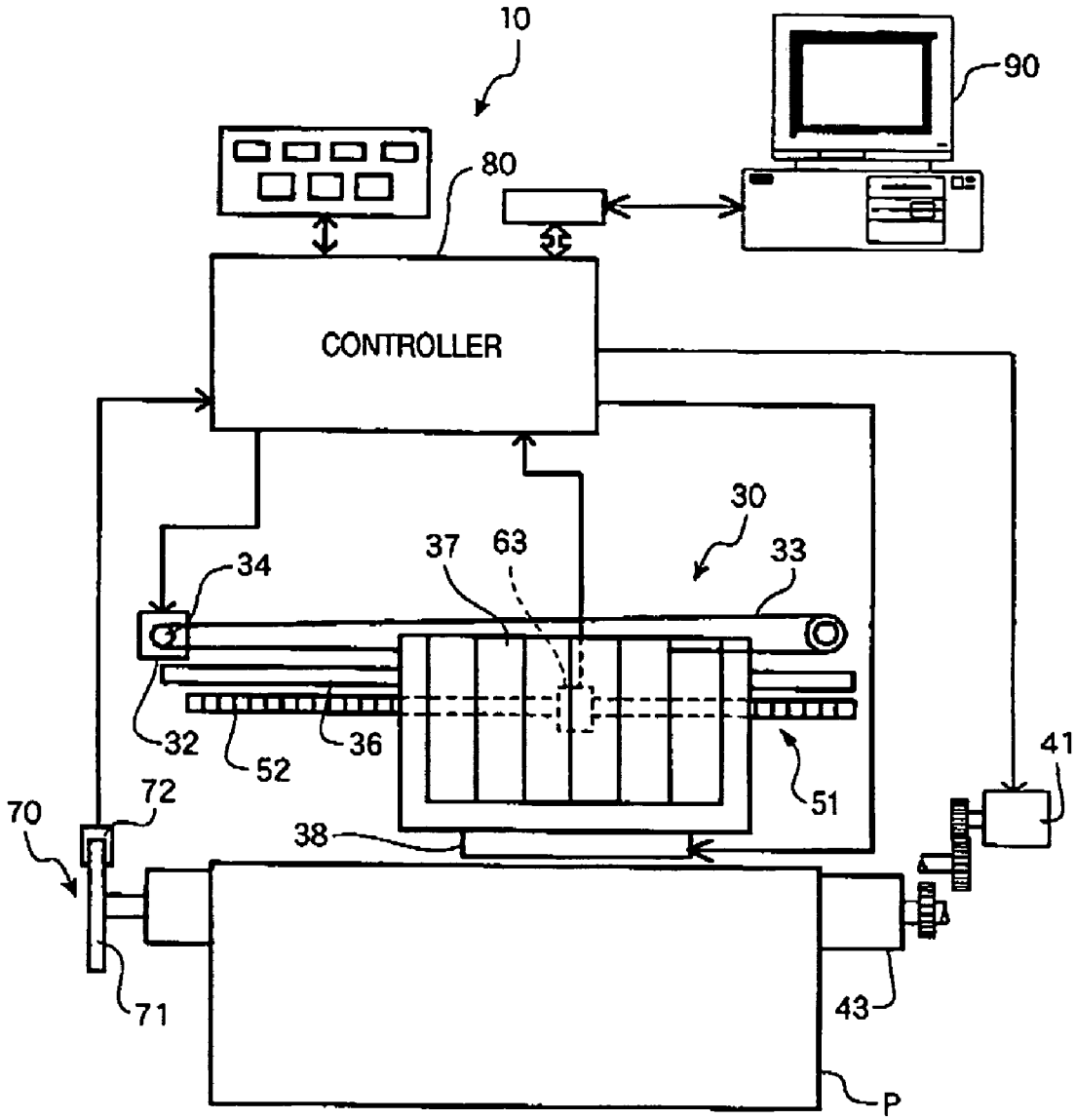
FIG. 2 is a schematic view showing a motor driving control system in the printer.

The housing 20 includes a chassis 21 placed on an installation surface, and a supporting frame 22 provide upright which extends from this chassis 21 upward. The carriage driving mechanism 30 includes a carriage 31, a carriage motor 32, a belt 33, a driving pulley 34, a follower pulley 35, and a carriage shaft 36. On the carriage 31, an ink cartridge 37 can be mounted. As shown in FIG. 2, on the lower face of the carriage 31, a printing head 38 which can eject ink droplets is provided. The belt 33 is an endless belt, and its part is fixed onto the rear face of the carriage 31. This belt 33 is stretched between the driving pulley 34 and the follower pulley 35.

The above printing head 38 is provided with not-shown nozzle arrays corresponding to each color of ink. In nozzles constituting this nozzle array, not-shown piezoelectric elements are arranged. By the operation of this piezoelectric element, the ink droplet can be ejected from the nozzle that is located at the end portion of an ink passage. The printing head 38 is not limited to the piezoelectric type using the piezoelectric element, but may adopt, for example, a heater type which heats ink and utilizes power of the produced bubbles, a magnetostrictive type which uses a magnetostrictive element, or a mist type which controls mist by an electric field. The ink filled into the cartridge 37 may be any kind of ink, for example, dye-based ink or pigment-based ink.

Figure 3:
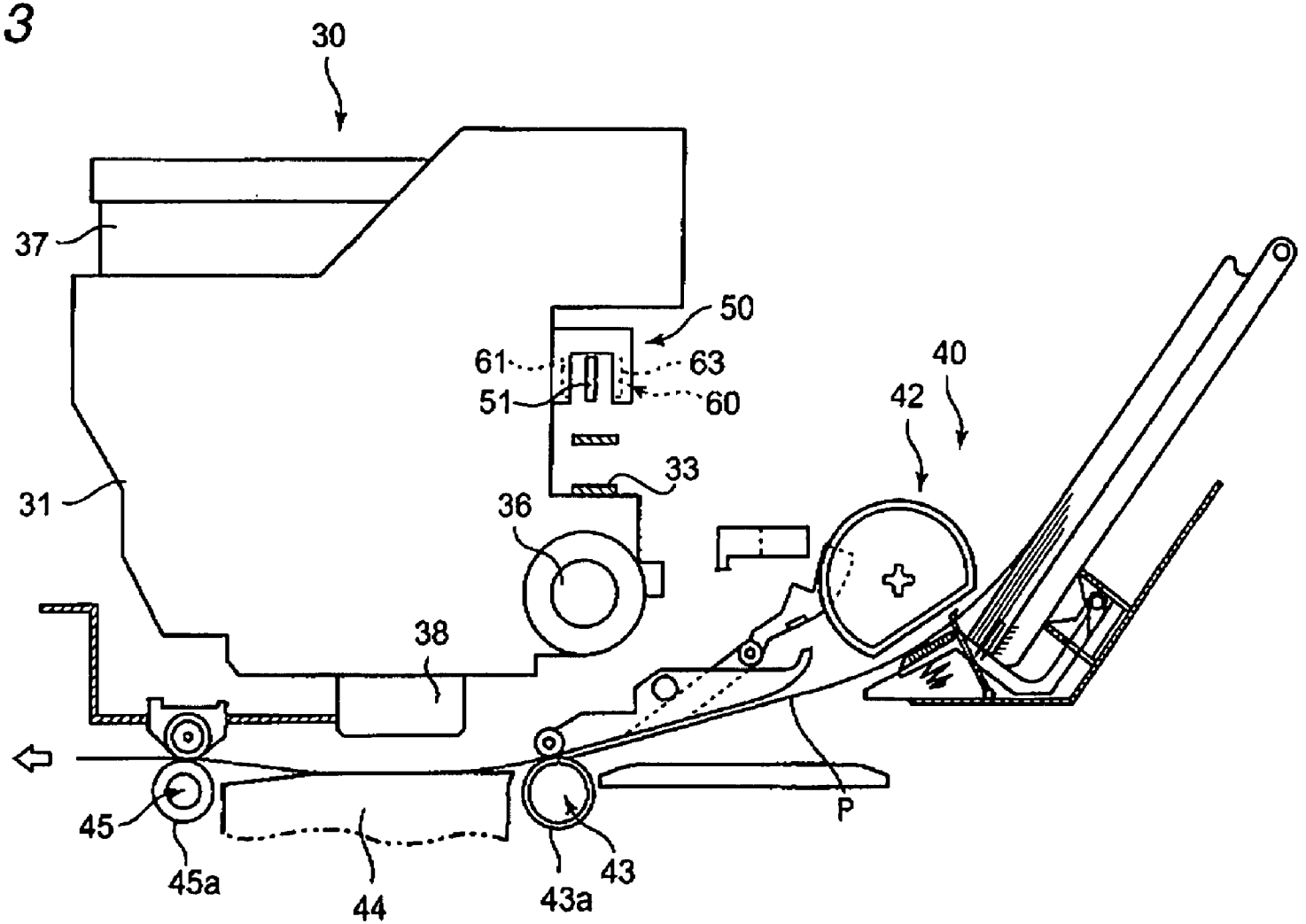
FIG. 3 is a schematic section view showing a sheet transporting system in the printer.

As shown in FIG. 3, the sheet transporting mechanism 40 includes a motor 41 and a sheet feeding roller 42 for feeding a printed subject P such as plain paper (refer to FIG. 2). On the downstream side of the sheet feeding roller 42, a sheet transporting roller pair 43 for transporting the printed subject P nipped therebetween is provided. On the downstream side of the sheet transporting roller pair 43, a platen 44 and the above-mentioned printing head 38 are provided so as to be opposed to each other in the vertical direction. The platen 44 supports, from the downside, the printed subject P being transported below the printing head 38 by the sheet transporting roller pair 43. On the downstream side of the platen 44, a sheet ejecting roller pair 45 similar to the sheet transporting roller pair 43 is provided. The driving force from the motor 41 is transmitted to a driving roller 43*a* in the sheet feeding roller pair 43 and a driving roller 45*a* in the sheet ejecting roller pair 45.

Figure 4:
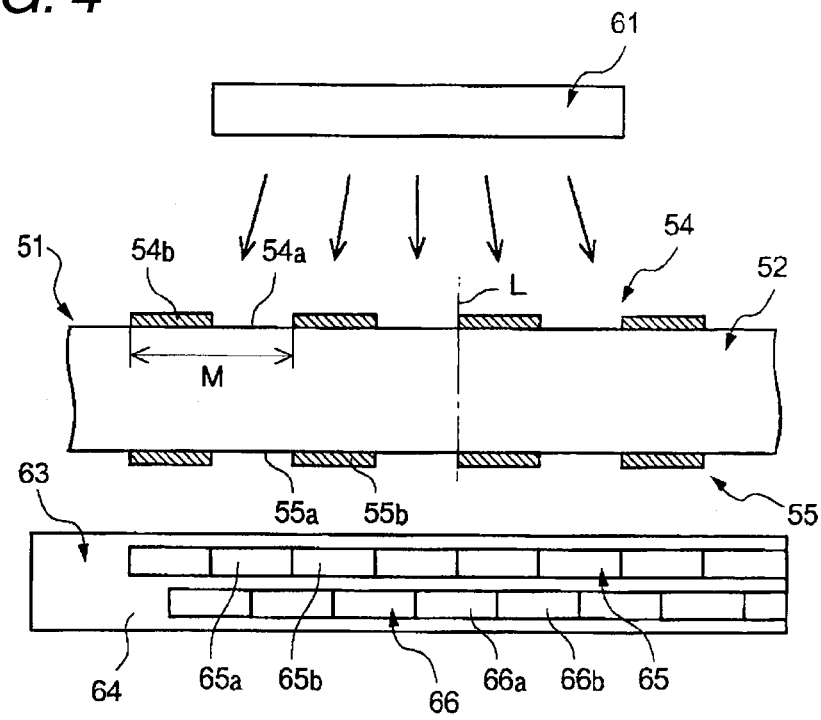
FIG. 4 is a schematic view showing a linear encoder in the printer.
Figure 5:
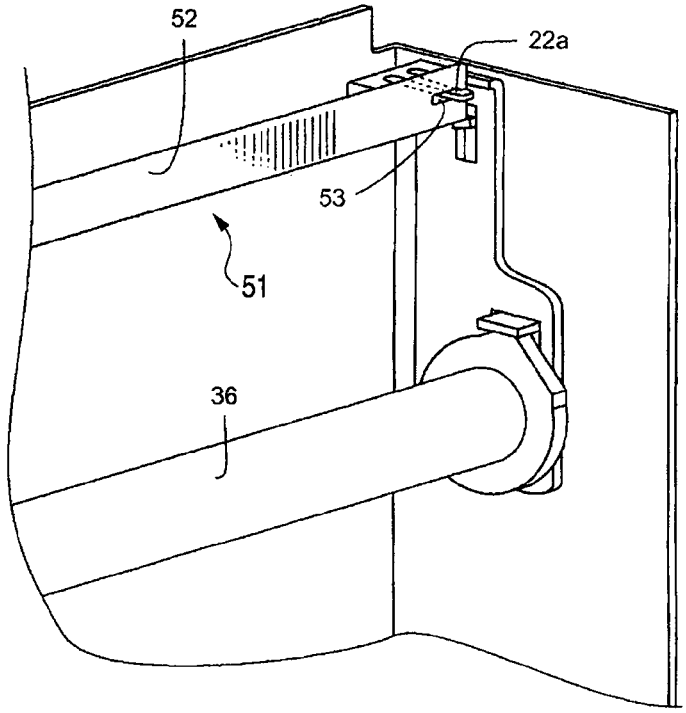
FIG. 5 is a perspective view showing a longitudinal end portion of a linear scale in the linear encoder.

As shown in FIG. 4, the linear encoder 50 includes a linear scale 51 and a photo sensor 60. The linear scale 51 is formed of an elongated transparent member 52 made of a transparent material such as PET (polyethylene terephthalate). However, other various materials can be applied as the transparent member. As shown in FIG. 5, holes 53 are formed at both longitudinal ends of the linear scale 51, and claws 22*a* provided on the supporting frame 22 are respectively inserted into the holes 53, so that the linear scale 51 is suspended between the claws 22*a*.

For convenience of description, of the transparent member 52, a surface facing a light emitter 61 (described later) will be described below as a front surface 52*a*, and a surface facing a light receiver 63 (described later) will be described as a back surface 52*b*.

As shown in FIG. 4, on the linear scale 51, a first line pattern 54 and a second line pattern 55 are formed. These line patterns 54 and 55 have, at regular intervals, first light transmitting sections 54*a* and second light transmitting sections 55*a* which transmit light, and first light shielding sections 54*b* and second light shielding sections 55*b* which cuts off transmission of the light. The light shielding sections 54*b* and 55*b* of them are formed by applying black printing with a fixed width and such thickness that the light does not pass therethrough. Onto the light transmitting sections 54*a* and 55*a*, the black printing is not applied, and they can transmit light emitted from the light emitter 61.

In the following description, the first light transmitting section 54*a* and the second light transmitting section 55*a* are sometimes collectively referred as the light transmitting sections 54*a* and 55*a*. The first light shielding section 54*b* and the second light shielding section 55*b* are sometimes collectively referred as the light shielding sections 54*b* and 55*b*.

In this embodiment, all of the light transmitting sections 54*a*, 55*a* and the light shielding sections 54*b*, 55*b* have the same width (i.e., the mask pitch M is constant). However, the width of each of the light transmitting section and the light shielding section may be varied (i.e., the mask pitch M may be varied) only if opposing ones of the light transmitting sections 54*a*, 55*a* and opposing ones of the light shielding sections 54*b*, 55*b* have the same width.

As shown in FIG. 4, these first line patterns 54 and the second line patterns 55 are formed at the same pitch. in the thickness direction of the linear scale 51, the two light transmitting sections 54*a* and 55*a* are aligned, and the two light shielding sections 54*b* and 55*b* are similarly aligned, so that a line L passing though a boundary between the light transmitting section 54*a* and the light shielding section 54*b* of the first line pattern 54 also passes through a boundary between the light transmitting section 55*a* and the light shielding section 55*b* of the second line pattern 55.

Figure 6:
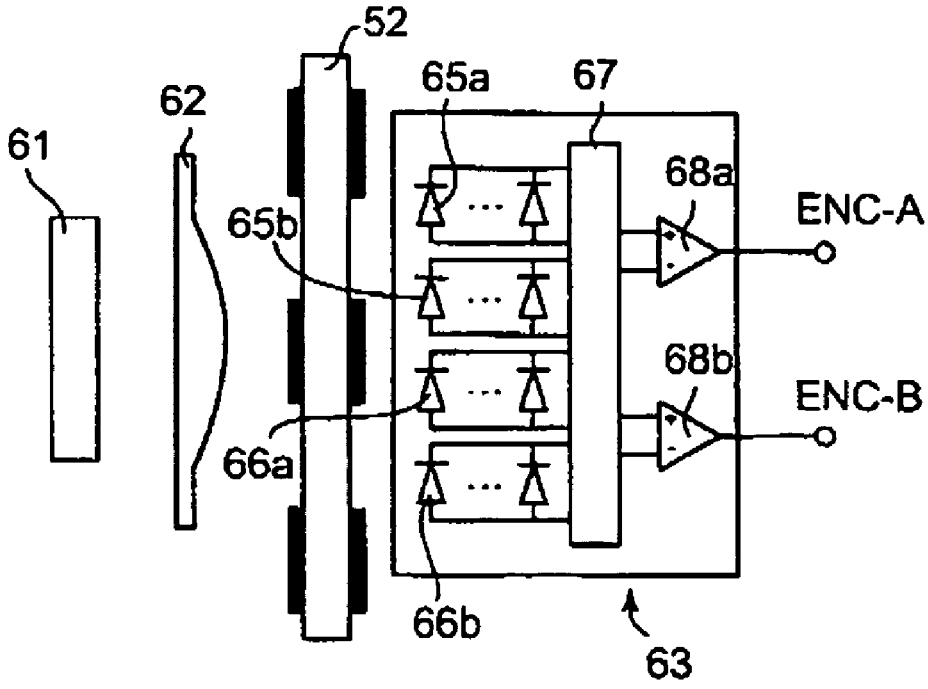
FIG. 6 is a diagram showing a detailed configuration of the linear encoder.

As shown in FIG. 6, the photo sensor 60 comprises a light emitter 61, a collimator lens 62, and a light receiver 63. These light emitter 61 and light receiver 63 are opposed to each other through the linear scale 51 located between the collimator lens 62 and the light receiver 63 in a non-contact manner. The light emitter 61 comprises a not-shown light emitting element such as a light emitting diode, and the light generated by this light emitting element is emitted toward the linear scale 51.

The light receiver 63 comprises a substrate 64, and a first light receiving element array 65 and a second light receiving element array 66 which are provided on this substrate 64. In the first light receiving element array 65, plural light receiving elements 65*a* and 65*b* are arrayed. Similarly, in the second light receiving element array 66, plural light receiving elements 66*a* and 66*b* are arrayed. Each of the light receiving elements 65*a*, 65*b*, 66*a*, and 66*b* can convert the received light into an electric signal according to the quantity of the received light. A phototransistor, a photodiode, a photo-IC or the like may be adopted as the light receiving element. These light receiving elements are arranged such that two elements are provided in every one segment (corresponding to the mask pitch M) constituted by a pair of the light transmitting section 54*a* (55*a*) and 54*b* (55*b*). Further, the first light receiving element array 65 and the second light receiving element array 66 are shifted from each other in the extending direction thereof by one fourth of the mask pitch M so that a phase difference between the arrays 65 and 66 becomes 90 degrees.

In a case where the width dimension of the light transmitting section 54*a*, 55*a* is the same as that of the light shielding section 54*b*, 55*b* as in this embodiment, one light receiving element is associated with each of the light emitting sections 54*a* (55*a*) and the light shielding sections 54*b* (55*b*).

As shown in FIG. 6, the plural light receiving elements 65*a*, 65*b*, 66*a*, 66*b* are connected to a signal amplifier 67. Analog waveform signals outputted from the light receiving elements, after being amplified by this signal amplifier 67, are outputted to a first comparator 68*a* and a second comparator 68*b*. The first comparator 68*a* and the second comparator 68*b* output pulse waveform digital signals on the basis of the analog signals outputted through the signal amplifier 67 from the respective light receiving element arrays 65 and 66.

Figure 7:
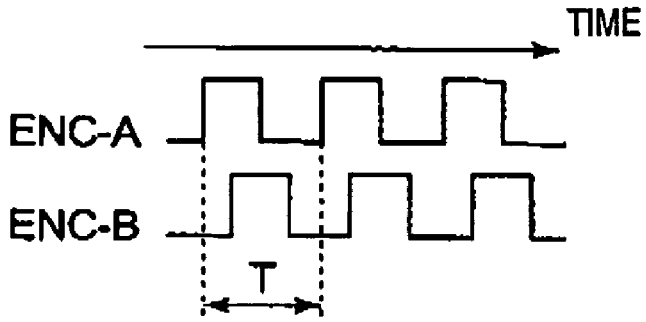
FIG. 7 is a timing chart showing signals outputted from the linear encoder.

Here, the light receiving element 65*a* in the first light receiving element array 65 is connected to a positive terminal of the first comparator 68*a*, and the light receiving element 65*b* in the first light receiving element array 65 is connected to a negative terminal of the first comparator 68*a*. The light receiving elements 66*a* and 66*b* in the second light receiving array 66 are similarly connected to the second comparator 68*b*. For example, in a case where the level of the analog signal inputted to the positive terminal is higher than the level of the analog signal inputted to the negative terminal, a high-level signal is outputted. In the contrary case, a low-level signal is outputted. Hereby, it is possible to output pulse signals (ENC-A, ENC-B) as shown in FIG. 7, corresponding to detection by the light transmitting section 54*a*, 55*a* and the light shielding section 54*b*, 55*b*.

A pulse signal ENC-A is outputted from the first comparator 68*a* corresponding to the first light receiving element array 65, and a pulse signal ENC-B in which the phase is shifted by 90 degrees is outputted from the second comparator 68*b* corresponding to the second light receiving element array 66 shifted by one fourth of the mask pitch M relative to the first light receiving element array 65.

Figure 8:
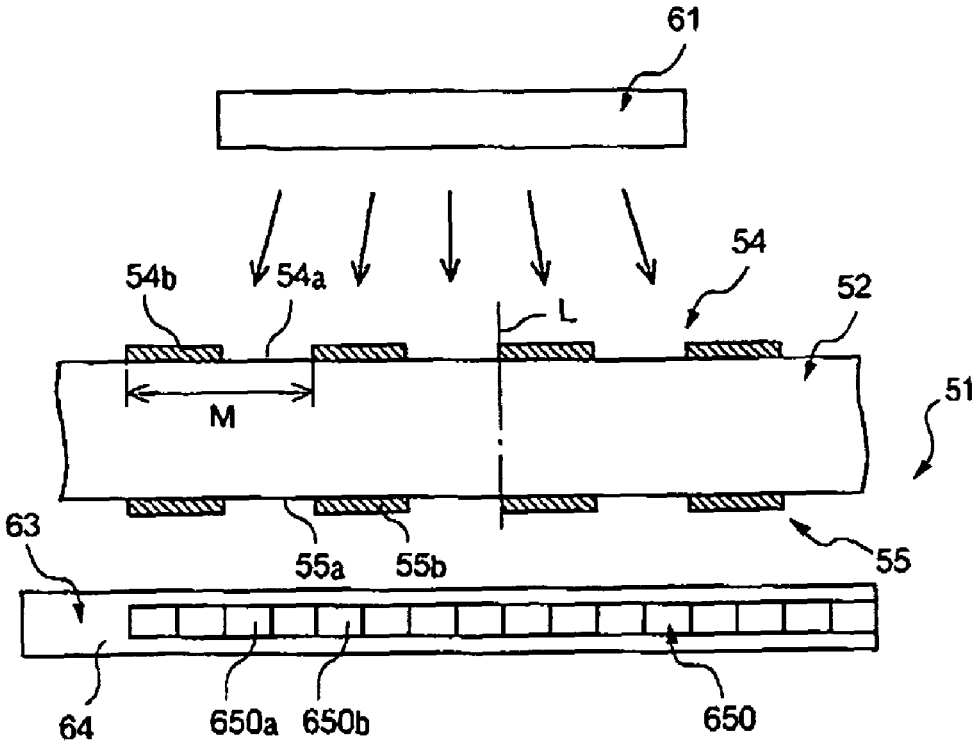
FIG. 8 is a schematic view showing a modified example of the linear encoder.

Here, as shown in FIG. 8, there may be adopted a configuration in which a single light receiving element array 650 is provided. In this case, a light receiving element 650*a* is connected to either a positive terminal or a negative terminal of the first comparator 68*a*, and a light receiving element 650*b* is connected to either a positive terminal or a negative terminal of the second comparator 68*b*.

Figure 9:
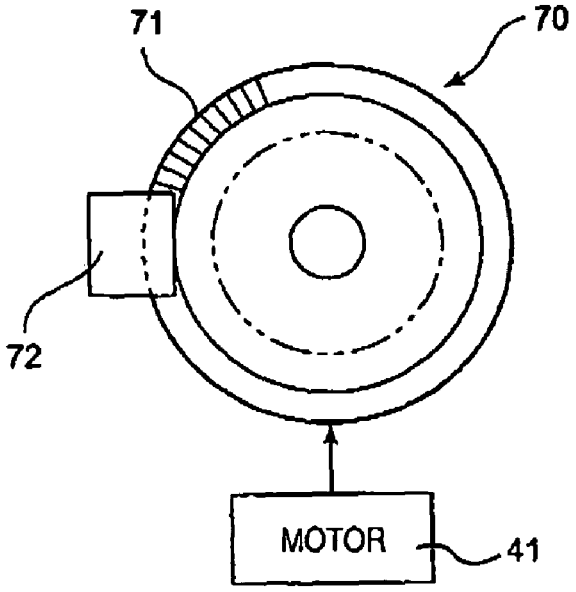
FIG. 9 is a schematic view showing a rotary encoder in the printer.

As shown in FIG. 9, the rotary encoder 70 comprises a disc-shaped scale 71 rotated by the motor 41, and a photo sensor 72 similar to the photo sensor 60 of the linear encoder 50. This rotary encoder 70 has the same constitution as that of the linear encoder 50 except that the scale 71 is formed in the shape of a disc. Therefore, the detailed description of the rotary encoder 70 is omitted.

As shown in FIG. 2, an encoder signal outputted from the linear encoder 50 or the rotary encoder 70, a print signal from a computer 90, and various output signals are inputted to a controller 80. More specifically, the controller 80 includes CPU, ROM, RAM, ASIC, a DC unit, and a driver to control the CR motor 32, the printing head 38, the motor 41, and the like.

When the printer 10 is operated under the above constitution, the operation performed by the linear encoder 50 will be described below.

When the linear encoder 50 is activated and the light emitter 61 emits the light toward the linear scale 51, the emitted light passes through the collimator lens 62, so that the light emergent from the collimator lens 62 becomes parallel light. However, since the emergent light is not complete parallel light, the emergent light to be incident on the light receiving elements 65*a* to 66*b* located on the longitudinal end portions of the light receiving element arrays 65, 66 becomes oblique relative to the thickness direction of the linear scale 51 as shown in FIG. 10.

Specifically, the thickness dimension of the transparent member 52 is not as large as each width dimension of the light transmitting sections 54*a*, 55*a* and the light shielding sections 54*b*, 55*b*. However, in a case where the thickness dimension of the transparent member 52 becomes somewhat large, it is possible to prevent well the light which travels obliquely inside the transparent member 52 from being emitted from the back surface 52*b*. This is because the second line pattern 55 are provided on the back surface 52*b* of the transparent member 52 in addition to the first line pattern 54 provided on the front surface 52*a* of the transparent member 52. That is, the light incident straightly on the first light transmitting section 54*a* of the first line pattern 54 passes straightly through the inside of the transparent member 52, and reaches the back surface 52*b*. However, the light incident obliquely on the first light transmitting section 54*a* travels obliquely inside the transparent member 52 and is blocked by the light shielding section 55*b* of the second line pattern 55.

Figure 10:
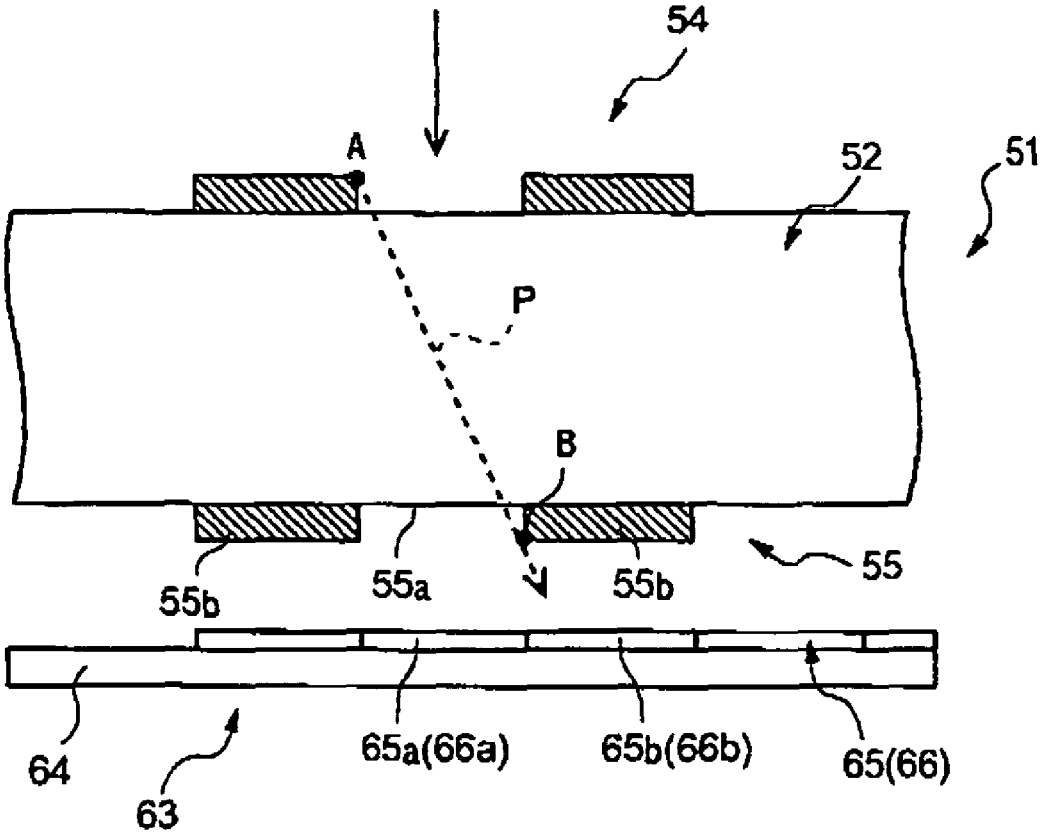
FIG. 10 is a diagram for explaining an advantageous effect obtained by the linear encoder.

More specifically, as shown in FIG. 10, it is desirable that a line Q connecting a point A of the light shielding section 54*b* and a point B of the light shielding section 55*b* reaches a spot on the surface of any one of the light receiving elements 65*a*, 65*b*, 66*a* and 66*b* that is located closer to the light transmitting section 55*a* than the light shielding section 55*b*. Therefore, the light traveling obliquely can be surely blocked in a case where the thickness dimension of the transparent member 52 is made much larger than the width dimension of the light transmitting sections 54*a*, 55*a* and the light shielding section 54*b*, 55*b*.

With the above configuration, the light having high straightness is emitted from the second light transmitting section 55*a* on the back surface 52*b* and is incident on an associated one of the light receiving elements 65*a*, 65*b*, 66*a* and 66*b*. In accordance with the detection state of the light receiving elements, analog signals are outputted according to the amount of the detected light, and thereafter the pulse signal ENC-A and the pulse signal ENC-B that are the digital signals are outputted respectively through the first comparator 68*a* and the second comparator 68*b*.

In accordance with the pulse signals ENC-A and ENC-B, the controller 80 drives the motor 41 one pitch by one pitch, and controls the carriage motor 32 while detecting the position of the carriage 3. Further, the controller 80 generates a print signal for controlling ink ejection from the print head 38, thereby performing printing with respect to the printed medium P.

With the above configuration, only the light emitted from the light emitter 61 and having reached the first light transmitting section 54*a* passes through the transparent member 52, and the light that has reached the first light shielding section 54*b* is shielded and does not pass through the transparent member 52. The light that has passed through the transparent member 52 then reaches the second line pattern 55. Here, only the light that has reached the second light transmitting section 55*a* passes toward the light receiver 63 side, and the light that has reached the second light shielding section 55*b* is blocked. Therefore, of the light emitted from the light emitter 61, only the light that has passed through both of the light transmitting section 54*a* and the light transmitting section 55*a* is received in the light receiver 63.

Hereby, the light of which the traveling direction deviates from the predetermined traveling direction, though passing through the first transmitting section 54*a*, can be shielded by the second light shielding section 55*b*, whereby only the light in the predetermined traveling direction can be received by the light receiver 63. Hereby, the light receiver 63 can suppress the reception of excessively diffused or diffracted light. This advantageous effect is remarkable particularly in a case where the pigment-based ink is used. Therefore, the light receiver 63 can output the electric signal corresponding to the light that travels in the predetermined direction, and detection accuracy of the light in the predetermined traveling direction can be improved. Namely, detection sensitivity in the light receiver 63 can be improved, so that the erroneous detection can be prevented. Accordingly, it is possible to eject the ink droplet toward the printed subject P accurately, so that the printing accuracy can be improved.

Since the mask pitch M of the first line pattern 54 and the mask pitch M of the second line pattern 55 are the same, the traveling direction of the light that has passed through both of the first transmitting section 54*a* and the second light transmitting section 55*a* is made uniform.

Since the first line pattern 54 is provided on the front surface 52*a* of the transparent member 52 and the second line pattern 55 is provided on the back surface 52*b* of the same transparent member 52, it is possible to avoid the increase of dimension in the thickness direction of the transparent member 52, in comparison with the two line patterns are respectively provided on individual transparent members. Further, influences by light reflection from the front surface 52*a* can be reduced.

Since each boundary between the light transmitting section 54*a* and the light shielding section 54*b* is aligned with an associated boundary between the light transmitting section 55*a* and the light shielding section 55*b*, the light having passed through the transparent member 52 is made parallel relative to the thickness direction of the transparent member 52. Thus, in the light receiver 63, the influences of the diffused or diffracted light can be reduced.

Since the mask pitch M corresponds to the width dimension of a pair of the light receiving element 65*a* (66*a*) and the light receiving element 65*b* (66*b*), at least one of the light receiving elements 65*a*, 65*b*, 66*a*, 66*b* must be associated with each of the light transmitting sections 54*a* (55*a*) and the light shielding sections 54*b* (55*b*). Therefore, among these light receiving elements, the signals in which the phase is shifted by 180 degrees can be outputted, and it is possible to obtain an encoder signal having high accuracy by comparison between these signals.

In the above embodiment, the first line pattern 54 and the second line patter 55 are provided on a single transparent member 52. However, two transparent members each of which is provided with a single line pattern on either a front surface or a back surface thereof may be laminated to obtain two line patterns.

In this case, it is possible to obtain the desired two line patterns by merely laminating two transparent members while positioning the respective line patterns. Further, relative position between two line patterns can be easily corrected.

Further, two or more transparent members each of which is provided with two line patterns on both surfaces may be laminated, and three or more transparent members each of which is provided with a single line pattern as described the above may be laminated. The line pattern may be provided inside the transparent member.

In the above embodiment, the printer 10 is exemplified as the liquid ejecting apparatus. However, the liquid ejecting apparatus may be any apparatus such as a color filter manufacturing apparatus, a dyeing machine, a micromachine, a semiconductor processing machine, a surface processing machine, a three-dimensional molding machine, a liquid vaporizing apparatus, an organic EL manufacturing apparatus (particularly, polymer EL manufacturing apparatus), a display manufacturing apparatus, a film coating system, and a DNA chip manufacturing apparatus. Here, liquid ejected from the apparatus is changed according to its purpose. For example, metal material, organic material, magnetic material, conductive material, wiring material, film coating material, and various processing liquid may be adopted.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application No. 2005-263444 filed Sep. 12, 2006 including specification, drawings and claims is incorporated herein by reference in its entirety.

What is claimed is:

1. A position detector, comprising:

a light emitter, operable to emit light;

a light receiver, adapted to receive the light emitted from the light emitter, and operable to output a signal in accordance with an amount of the received light, thereby detecting a position of an object;

at least one transparent member, disposed between the light emitter and the light receiver;

a first line pattern, provided with the transparent member so as to oppose the light emitter, and including first light transmitting sections and first light shielding sections which are alternately arranged in a first direction with a first pitch; and a second line pattern, provided with the transparent member so as to oppose the light receiver, and including second light transmitting sections and second light shielding sections which are alternately arranged in the first direction with a second pitch, wherein:

each of the first light transmitting sections is adapted to allow the light emitted from the light emitter to pass through;

each of the first light shielding sections is adapted to shield the light emitted from the light emitter;

each of the second light transmitting sections is adapted to allow light having passed through the transparent member; and each of the second light shielding sections is adapted to shield the light having passed through the transparent member, wherein:

the transparent member is a single member having a first surface opposing the light emitter, and a second surface opposite to the first surface and opposing the light receiver;

the first line pattern is provided on the first surface;

the second line pattern is provided on the second surface; and each boundary between one of the first light transmitting sections and one of the first light shielding sections which are adjacent to each other is aligned with an associated boundary between one of the second light transmitting sections and one of the second light shielding sections which are adjacent to each other, relative to a thickness direction of the transparent member which is orthogonal to the first direction.

2. The position detector as set forth in claim 1, wherein:

the first pitch and the second pitch are identical.

3. The position detector as set forth in claim 1, wherein:

the light receiver includes a plurality of light receiving elements arrayed in the first direction; and a dimension in the first direction of one of the first light transmitting sections and one of the light shielding sections which are adjacent to each other corresponds to a dimension in the first direction of an odd number of the light receiving elements.

4. A liquid ejecting apparatus, comprising:

a liquid ejecting head, operable to eject liquid toward a target medium; and the position detector as set forth in claim 1, operable to detect a position of the liquid ejecting head as the object.

5. The liquid ejecting apparatus as set forth in claim 4, wherein:

the liquid is pigment-base ink.

* * * * *